US012667193B2

(12) United States Patent
Li et al.

(10) Patent No.: US 12,667,193 B2
(45) Date of Patent: Jun. 30, 2026

(54) MAGNETICALLY-DRIVEN CONTROL METHOD FOR SMART ROCKING CHAIR

(71) Applicant: Jiangsu Carya Smart Home Hardware Co. Ltd, Yangzhou (CN)

(72) Inventors: Bin Li, Yangzhou (CN); Wei Jiang, Yangzhou (CN); Wei Lu, Yangzhou (CN)

(73) Assignee: JIANGSU CARYA SMART HOME HARDWARE CO. LTD, Yangzhou (CN)

( * ) Notice: Subject to any disclaimer, the term of this patent is extended or adjusted under 35 U.S.C. 154(b) by 161 days.

(21) Appl. No.: 18/826,234

(22) Filed: Sep. 6, 2024

(65) Prior Publication Data

US 2025/0386937 A1 Dec. 25, 2025

(30) Foreign Application Priority Data

Jun. 19, 2024 (CN) ..... 202410792898.4

(51) Int. Cl.
*A47C 3/025* (2006.01)

(52) U.S. Cl.
CPC ..... *A47C 3/0251* (2018.08)

(58) Field of Classification Search
CPC ..... A47C 3/0251; A47C 3/02
USPC ..... 361/170
See application file for complete search history.

(56) References Cited

U.S. PATENT DOCUMENTS

2022/0202186 A1* 6/2022 Duncan, III ..... A47D 13/105

* cited by examiner

*Primary Examiner* — Joshua J Michener
*Assistant Examiner* — Nevena Aleksic
(74) *Attorney, Agent, or Firm* — Bayramoglu Law Offices LLC

(57) ABSTRACT

The provided is a magnetically-driven control method for a smart rocking chair. The magnetically-driven control method for a smart rocking chair includes the following steps: S1: starting-up: turning on a state detection and control system, and selecting a gear; S2: gear detection; S3: rocking starting: allowing the state detection and control system to power on an electromagnetic drive mechanism; and S4: comprehensive data processing and condition determination: if a real-time angle uL of a rocking chair is less than a preset rocking angle of the selected gear, proceeding cyclic excited rocking; or otherwise, proceeding force-applied free rocking. The magnetically-driven control method solves the problem that the prior art has the stiff action, and cannot simulate natural rocking under an action of the gravity to cause the poor comfort and affect the user experience.

6 Claims, 7 Drawing Sheets

MAGNETICALLY-DRIVEN CONTROL METHOD FOR SMART ROCKING CHAIR

CROSS-REFERENCE TO THE RELATED APPLICATIONS

This application is based upon and claims priority to Chinese Patent Application No. 202410792898.4, filed on Jun. 19, 2024, the entire contents of which are incorporated herein by reference.

TECHNICAL FIELD

The present disclosure relates to the field of household manufacturing, and in particular to a magnetically-driven control method for a smart rocking chair.

BACKGROUND

For automatic rocking sofa products in existing markets, a motor drives a crankshaft rocking rod mechanism to move up and down, thereby driving a movable portion of the sofa to rock back and forth. However, these products can only move back and forth mechanically with a stiffness and cannot simulate the natural rocking under the action of a gravity. This causes poor comfort and affects the user experience.

SUMMARY

In view of shortages of the prior art, an objective of the present disclosure is to provide a magnetically-driven control method for a smart rocking chair with a flexible action and a desirable comfort, thereby improving the user experience.

To achieve the above objective, the magnetically-driven control method for a smart rocking chair provided by the present disclosure adopts the following technical solutions:

A magnetically-driven control method for a smart rocking chair includes the following steps:

S1: starting-up: turning on a state detection and control system, and selecting a gear;

S2: gear detection;

S3: rocking starting:

S31: allowing the state detection and control system to power on an electromagnetic drive mechanism, where a power-on voltage gradually changes from a preset value to zero according to a preset pulse width modulation (PWM) straight line of a corresponding gear, and power-on time is 0 to t/2, t being time required by a rocking chair to rock back and forth once at the corresponding gear; and

S32: after the rocking chair moves to a real-time highest point Lm at one side under an action of an electromagnetic force, detecting that an angular velocity ωL of the rocking chair is 0, and an angular acceleration αL of the rocking chair starts to decrease; allowing the state detection and control system to power off the electromagnetic drive mechanism; and allowing the state detection and control system to record a real-time angle uL of the rocking chair; and

S4: comprehensive data processing and condition determination: if the real-time angle uL of the rocking chair is less than a preset rocking angle of the selected gear, proceeding cyclic excited rocking; or otherwise, proceeding force-applied free rocking, where the cyclic excited rocking: after the electromagnetic drive mechanism is powered off, allowing the rocking chair to move to the other side under an action of a gravity until a real-time highest point Rm at the other side, where the state detection and control system detects that an angular velocity ωR of the rocking chair is 0, and an angular acceleration αR of the rocking chair starts to decrease, and records a real-time angle uR of the rocking chair; powering on the electromagnetic drive mechanism again, where a power-on voltage gradually increases from a preset smaller value according to a preset PWM curve of a corresponding gear, reaches and maintains at a preset maximum value when the rocking chair moves to a region nearby a lowest point, then decreases gradually, and drops to zero when the rocking chair reaches or approaches to the opposite real-time highest point Lm, and the state detection and control system detects that the angular velocity ωL of the rocking chair is 0, and the angular acceleration αL starts to decrease; and powering off the electromagnetic drive mechanism again, and recording the real-time angle uL of the rocking chair, until the real-time angle uL is equal to or greater than the preset rocking angle of the selected gear; and the force-applied free rocking: taking that the real-time angular velocity (OR of the rocking chair is 0, and the real-time angular acceleration αR of the rocking chair starts to decrease as a first determination condition for applying the electromagnetic force; and taking that the real-time angle uR of the rocking chair meets 70-99% of a previously acquired uR value as a second determination condition for applying the electromagnetic force, where after the first determination condition and the second determination condition are met, the state detection and control system is detected to power on the electromagnetic drive mechanism for less than t/2; and in a power-on process, there are three parts including a linear voltage increasing stage, a voltage maintenance stage and a linear voltage decreasing stage, or two parts including the linear voltage increasing stage and the linear voltage decreasing stage.

Preferably, there are a plurality of gears; different gears correspond to different rocking amplitudes of the rocking chair; when a shift-up button is pressed, the state detection and control system detects a corresponding gear signal, and provides a matching PWM voltage control curve, and the rocking amplitude increases by improving the electromagnetic force; and when a shift-down button is pressed, the state detection and control system also detects a corresponding gear signal, and provides a matching PWM voltage control curve, and the rocking amplitude decreases by reducing the electromagnetic force.

Preferably, in the force-applied free rocking, when detecting that the rocking chair reaches the real-time highest point Lm, and the real-time angle uR is greater than a preset maximum value LK, or detecting that the rocking chair reaches the real-time highest point Rm, and the real-time angle uR is greater than a preset maximum value RK, the state detection and control system determines that the rocking chair is in an idle state, and sends a stop instruction to stop the rocking chair.

Preferably, in the force-applied free rocking, that the angular velocity OR of the rocking chair is 0, and the angular acceleration αR of the rocking chair starts to decrease is taken as the first determination condition for applying the electromagnetic force; and that the real-time angle uR of the rocking chair meets 70-99% of the previously acquired uR value is taken as the second determination condition for applying the electromagnetic force.

Preferably, the electromagnetic drive mechanism includes a mounting base; the mounting base includes one side provided with a drum coil, and the other side provided with a linear bearing; a telescopic mandrel penetrates through the linear bearing; and an end of the telescopic mandrel away from the drum coil is hinged to the rocking chair.

Preferably, the state detection and control system includes a drive circuit connected to the drum coil; the drive circuit is connected to a microcontrol unit (MCU); the MCU is connected to a buzzer, a voltage conversion circuit, and a movement information monitoring mechanism; and the drive circuit and the voltage conversion circuit are connected to an adapter through a low-voltage fuse.

Preferably, the movement information monitoring mechanism is a gyroscope or a gravitational acceleration sensor.

Compared with the prior art, the present disclosure has the following advantages:

1. After the user sits on the rocking chair, the rocking chair starts rocking according to a selected gear, and then gradually enters a force-applied free rocking state. In the rocking starting and the force-applied free rocking, the state detection and control system controls the power-on voltage and the power-on time of the electromagnetic drive mechanism, and the generated electromagnetic force changes with the voltage. Therefore, the present disclosure has the flexible action and the desirable comfort, thereby improving the user experience.
2. When the gear is shifted, the state detection and control system can provide the PWM voltage control curve matching with the gear, thereby meeting different experiences of the user.
3. When detecting that the rocking chair reaches the real-time highest point Lm, and the real-time angle uR is greater than the preset maximum value LK, or detecting that the rocking chair reaches the real-time highest point Rm, and the real-time angle uR is greater than the preset maximum value RK, the state detection and control system determines that the rocking chair is in an idle state, and sends a stop instruction to stop the rocking chair. This not only can save the energy, but also prevents the rocking chair from hitting the user or the article to improve the safety.
4. With two determination conditions for applying the electromagnetic force, the present disclosure prevents the state detection and control system from powering on the electromagnetic drive mechanism falsely, thereby ensuring normal rocking of the rocking chair.

In the FIGURES: 1: state detection and control system, 11: drive circuit, 12: MCU, 13: buzzer, 14: voltage conversion circuit, 15: movement information monitoring mechanism, 16: low-voltage fuse, 2: electromagnetic drive mechanism, 21: mounting base, 22: drum coil, 23: linear bearing, 24: telescopic mandrel, 3: rocking chair, 4: adapter, and 5: power supply.

DETAILED DESCRIPTION OF THE EMBODIMENTS

The present disclosure is further described below with reference to the accompanying drawings and specific implementations. It should be understood that these implementations are only intended to illustrate the present disclosure and are not intended to limit the scope of the present disclosure. Modifications of various equivalent forms made on the present disclosure by those skilled in the art after the reading of the present disclosure fall within the range defined by the appended claims of the present application.

Figure 1:
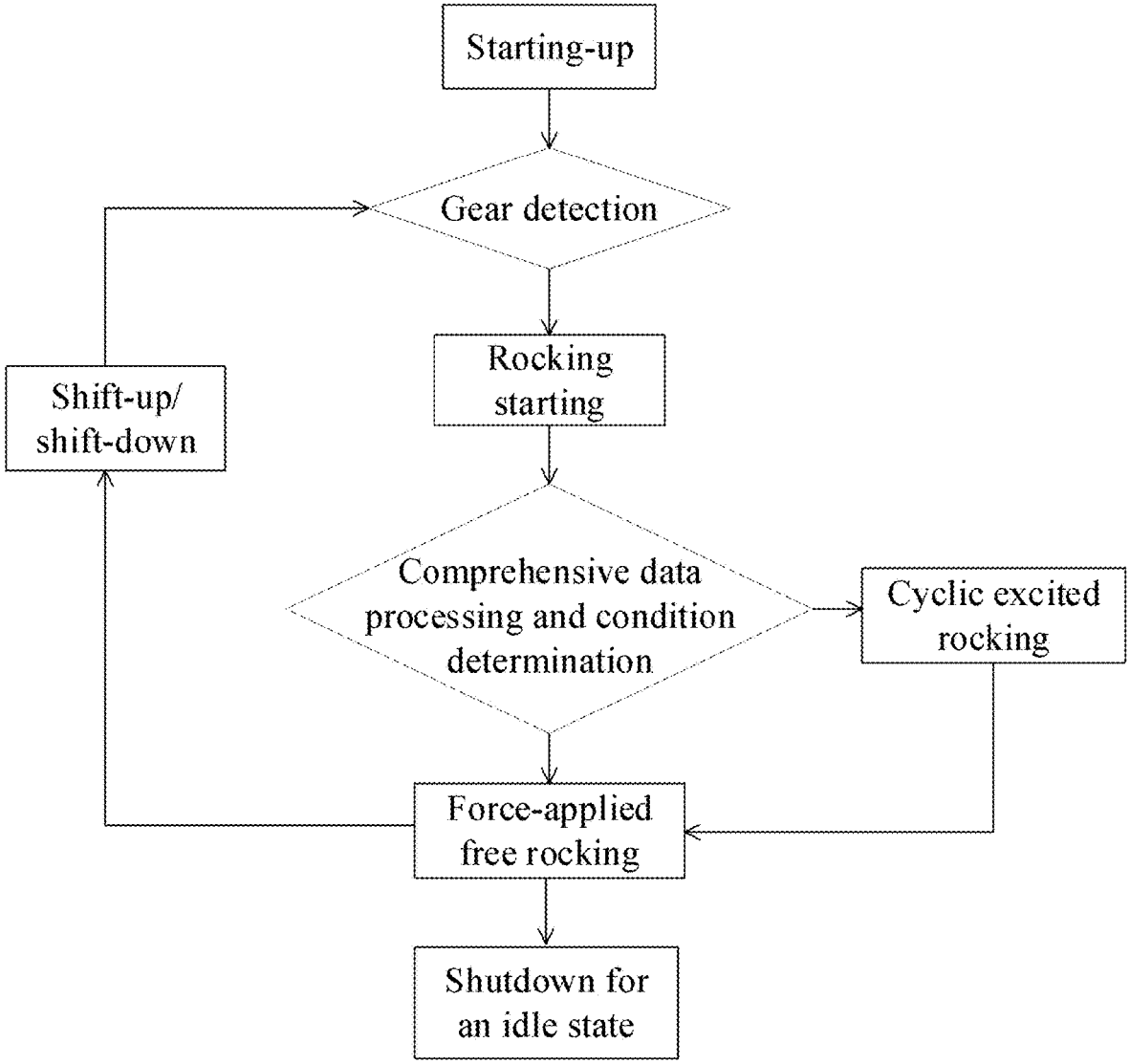
FIG. 1 illustrates a flowchart and a control logic of a magnetically-driven control method for a smart rocking chair according to the present disclosure.
Figure 2:
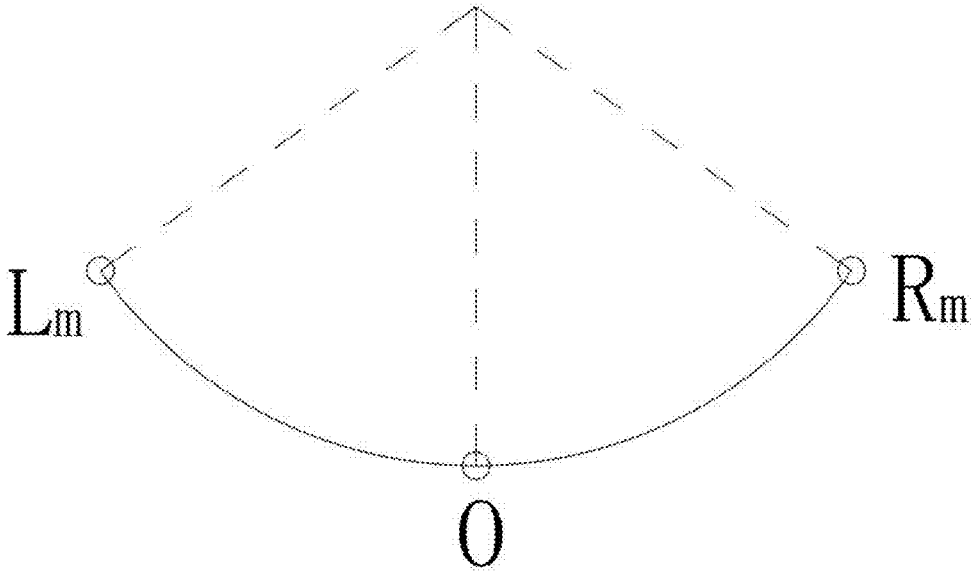
FIG. 2 illustrates a track of a rocking chair in rocking.
Figure 3:
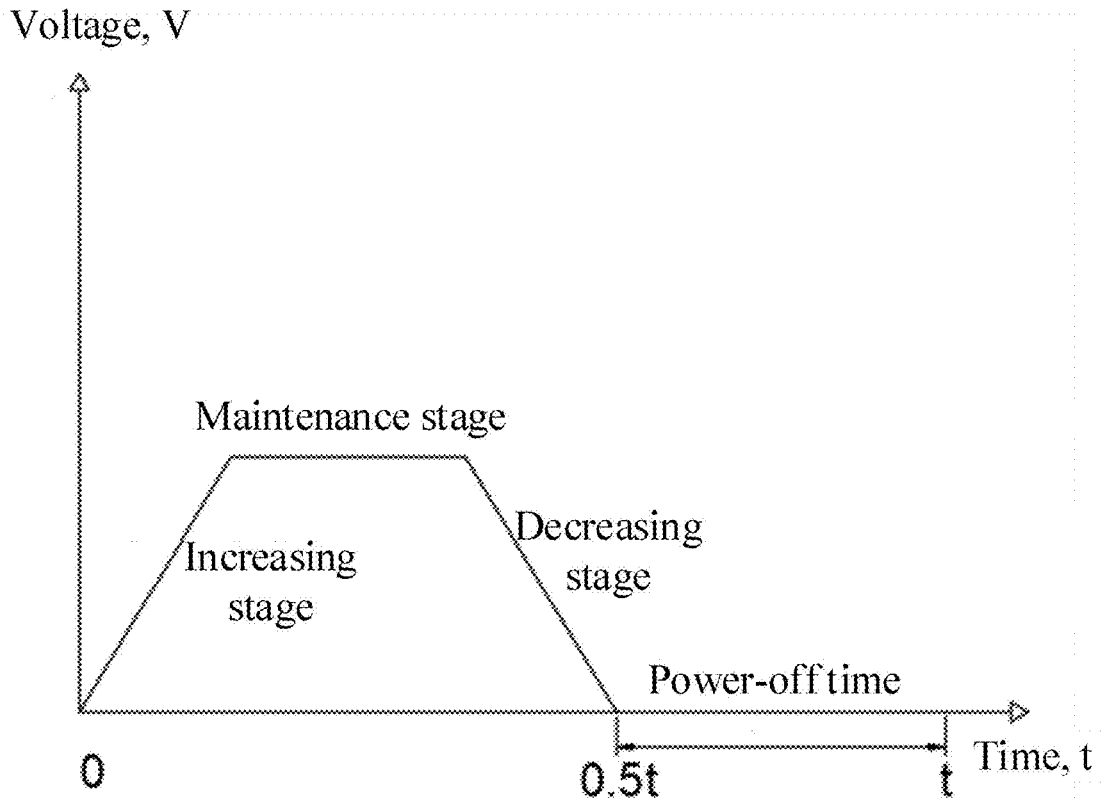
FIG. 3 is a schematic diagram illustrating a voltage change of a rocking chair in a unit rocking period (t) in force-applied free rocking.
Figure 4:
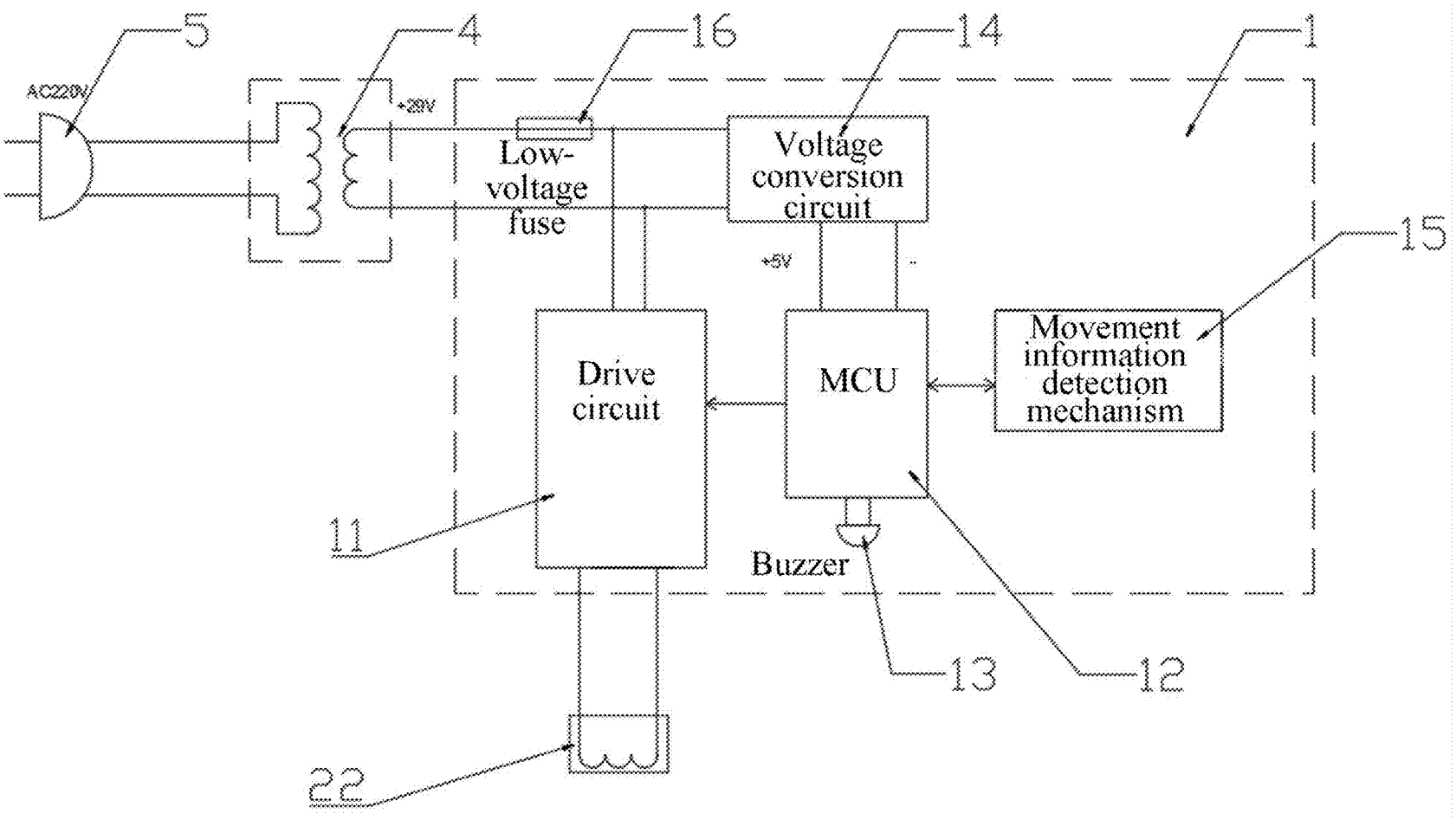
FIG. 4 is a schematic structural view of a state detection and control system.
Figure 5:
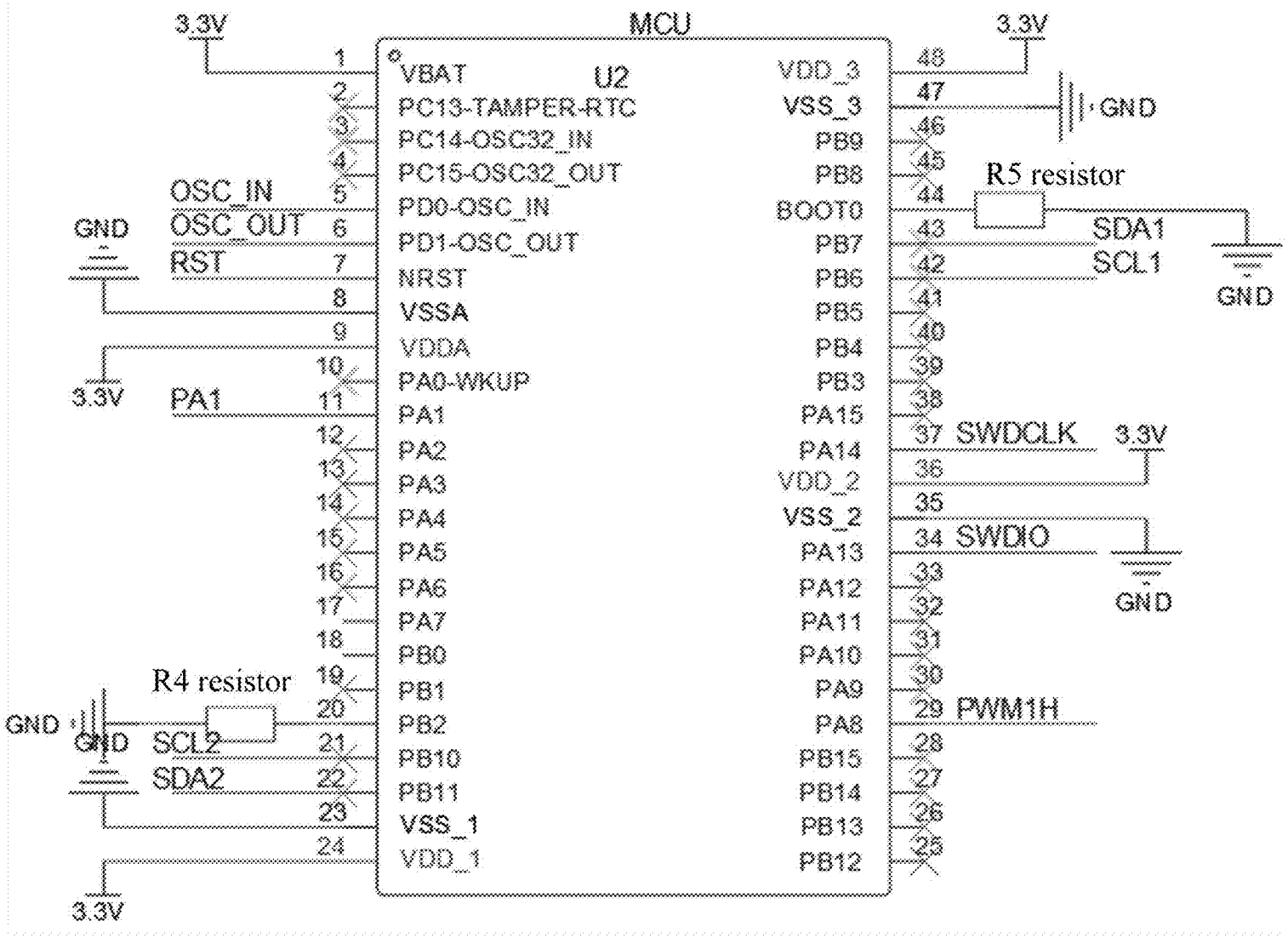
FIG. 5 is an electronic schematic diagram of an MCU.
Figure 6:
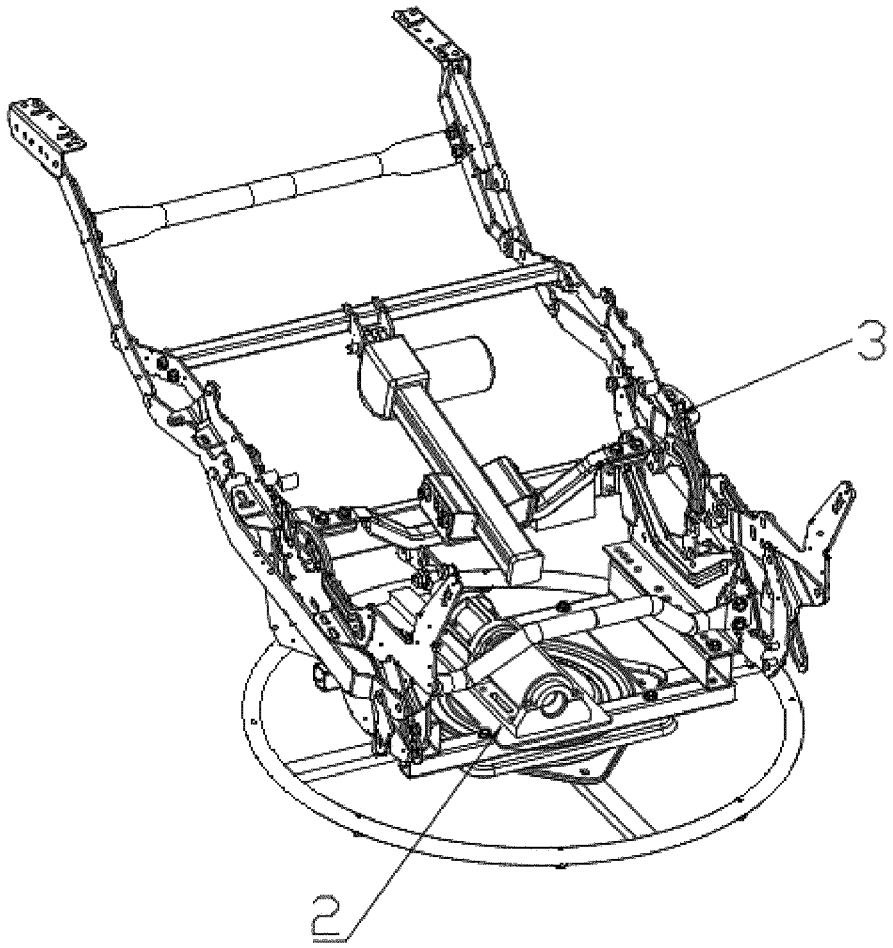
FIG. 6 is a schematic structural view of a rocking chair.
Figure 7:
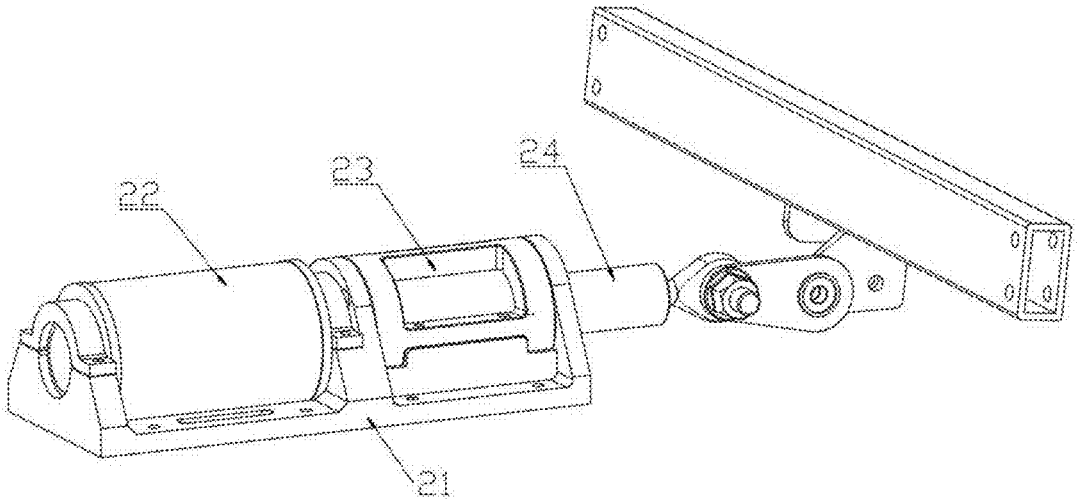
FIG. 7 is a schematic structural view of an electromagnetic drive mechanism.

As shown in FIG. 1 to FIG. 7, a magnetically-driven control method for a smart rocking chair includes the following steps:

S1: Starting-up: State detection and control system 1 is turned on, and a gear is selected. The state detection and control system controls electromagnetic drive mechanism 2 to realizing rocking of rocking chair 3. The electromagnetic drive mechanism includes mounting base 21. The mounting base includes a left side provided with drum coil 22, and a right side provided with linear bearing 23. Telescopic mandrel 24 penetrates through the linear bearing. An end of the telescopic mandrel away from the drum coil is hinged to the rocking chair. The state detection and control system includes drive circuit 11 connected to the drum coil. The drive circuit is connected to MCU 12. The MCU is connected to buzzer 13, voltage conversion circuit 14, and movement information monitoring mechanism 15. The movement information monitoring mechanism is a gyroscope. The drive circuit and the voltage conversion circuit are connected to adapter 4 through low-voltage fuse 16. The adapter is connected to power supply 5 to convert a 220 V alternating current (AC) into a 29 V direct current (DC). The 29 V DC can drive the drive circuit to work. The voltage conversion circuit converts the 29 V DC into a 5 V DC, to ensure normal work of the MCU. The low-voltage fuse protects the drive circuit and the voltage conversion circuit. The MCU receives detection data (an angle, an angular velocity, and an angular acceleration) of the gyroscope, and outputs a PWM signal to the drive circuit based on the detection data of the gyroscope. The drive circuit outputs a changeable voltage to the drum coil based on the PWM signal, so as to drive the coil to generate a changing magnetic field to provide a changeable electromagnetic force for the telescopic mandrel.

S2: Gear detection: The MCU receives a selected gear.

S3: Rocking starting:

S31: The MCU powers on the drum coil according to the selected gear. A power-on voltage gradually changes from a preset value to zero according to a preset PWM straight line of the corresponding gear, and power-on time is 0 to t/2, t being time required by the rocking chair to rock back and forth once at the corresponding gear.

S32: After the rocking chair moves to a real-time highest point Lm at a left side under an action of an electromagnetic force, the gyroscope detects that an angular velocity ωL of the rocking chair is 0, and an angular acceleration αL of the rocking chair starts to decrease, the MCU powers off the drum coil, and the state detection and control system records a real-time angle uL of the rocking chair.

S4: Comprehensive data processing and condition determination: If the real-time angle uL of the rocking chair is less than a preset rocking angle of the selected gear, cyclic excited rocking is proceeded. Or otherwise, force-applied free rocking is proceeded.

The cyclic excited rocking: After the electromagnetic drive mechanism is powered off, the rocking chair moves to a right side under an action of a gravity until a real-time highest point Rm at the other side. The gyroscope detects that an angular velocity ωR of the rocking chair is 0, and an angular acceleration αR of the rocking chair starts to decrease, and records a real-time angle uR of the rocking chair. The electromagnetic drive mechanism is powered on again. A power-on voltage gradually increases from a preset smaller value according to a preset PWM curve of a corresponding gear, reaches and maintains at a preset maximum value when the rocking chair moves to a region nearby a lowest point, then decreases gradually, and drops to zero when the rocking chair reaches or approaches to the opposite real-time highest point Lm. The state detection and control system detects that the angular velocity ωL of the rocking chair is 0, and the angular acceleration αL starts to decrease. The electromagnetic drive mechanism is powered off again, and the real-time angle uL of the rocking chair is recorded, until the real-time angle uL is equal to or greater than the preset rocking angle of the selected gear.

The force-applied free rocking: That the real-time angular velocity ωR of the rocking chair is 0, and the real-time angular acceleration αR of the rocking chair starts to decrease is taken as a first determination condition for applying the electromagnetic force. That the real-time angle uR of the rocking chair meets 70-99% of a previously acquired uR value is taken as a second determination condition for applying the electromagnetic force. With the two determination conditions, the false determination of the state detection and control system on a pose of a human body is prevented. When the user rocks the rocking chair, actions such as turning over the body, coughing, and taking a water cup are accompanied, which has an impact on acquisition of the real-time angular velocity and the real-time angular acceleration. The false determination frequently occurs for the single condition, such that the electromagnetic force is misapplied to seriously affect the normal rocking. After the first determination condition and the second determination condition are met, the state detection and control system is detected to power on the electromagnetic drive mechanism, so as to apply the electromagnetic force at right time to ensure normal rocking. The power-on time is less than t/2. In a power-on process, there are three parts including a linear voltage increasing stage, a voltage maintenance stage and a linear voltage decreasing stage, or two parts including the linear voltage increasing stage and the linear voltage decreasing stage. As the voltage changes, the electromagnetic force changes flexibly to improve the comfort.

In the force-applied free rocking, when detecting that the rocking chair reaches the real-time highest point Lm, and the real-time angle uR is greater than a preset maximum value LK, or detecting that the rocking chair reaches the real-time highest point Rm, and the real-time angle uR is greater than a preset maximum value RK, the state detection and control system determines that the rocking chair is in an idle state, and sends a stop instruction to stop the rocking chair. This not only can save the energy, but also prevents the rocking chair from hitting the user or the article to improve the safety.

In order to meet different experiences of the user, there are a plurality of gears. Different gears correspond to different rocking amplitudes of the rocking chair. When a shift-up button is pressed, the state detection and control system detects a corresponding gear signal, and provides a matching PWM voltage control curve, and the rocking amplitude increases by improving the electromagnetic force. When a shift-down button is pressed, the state detection and control system also detects a corresponding gear signal, and provides a matching PWM voltage control curve, and the rocking amplitude decreases by reducing the electromagnetic force.

What is claimed is:

1. A magnetically-driven control method for a smart rocking chair, comprising the following steps:

S1: starting-up: turning on a state detection and control system, and selecting a gear;

S2: gear detection;

S3: rocking starting:

S31: allowing the state detection and control system to power on an electromagnetic drive mechanism, wherein a power-on voltage gradually changes from a preset value to zero according to a preset pulse width modulation (PWM) curve of a corresponding gear, and power-on time is 0 to t/2, t being time required by a rocking chair to rock back and forth once at the corresponding gear; and S32: after the rocking chair moves to a real-time highest point Lm at a first side under an action of an electromagnetic force, detecting that an angular velocity ωL of the rocking chair is 0, and an angular acceleration αL of the rocking chair starts to decrease; allowing the state detection and control system to power off the electromagnetic drive mechanism; and allowing the state detection and control system to record a real-time angle uL of the rocking chair; and S4: comprehensive data processing and condition determination: when the real-time angle uL of the rocking chair is less than a preset rocking angle of the selected gear, proceeding cyclic excited rocking; when the real-time angle uL of the rocking chair is greater than or equal to the preset rocking angle of the selected gear, proceeding force-applied free rocking, wherein the cyclic excited rocking: after the electromagnetic drive mechanism is powered off, allowing the rocking chair to move to a second side under an action of a gravity until a real-time highest point Rm at the second side, wherein the state detection and control system detects that an angular velocity ωR of the rocking chair is 0, and an angular acceleration αR of the rocking chair starts to decrease, and records a real-time angle uR of the rocking chair; powering on the electromagnetic drive mechanism again, wherein a power-on voltage gradually increases from a preset smaller value according to the preset PWM curve of the corresponding gear, reaches and maintains at a preset maximum value when the rocking chair moves to a region nearby a lowest point, then decreases gradually, and drops to zero when the rocking chair reaches or approaches to the opposite real-time highest point Lm, and the state detection and control system detects that the angular velocity ωL of the rocking chair is 0, and the angular acceleration αL starts to decrease; and powering off the electromagnetic drive mechanism again, and recording the real-time angle uL of the rocking chair, until the real-time angle uL is equal to or greater than the preset rocking angle of the selected gear; and the force-applied free rocking: taking that the real-time angular velocity ωR of the rocking chair is 0, and the real-time angular acceleration αR of the rocking chair starts to decrease as a first determination condition for applying the electromagnetic force; and taking that the real-time angle uR of the rocking chair meets 70-99% of a previously acquired uR value as a second determination condition for applying the electromagnetic force, wherein after the first determination condition and the second determination condition are met, the state detection and control system is detected to power on the electromagnetic drive mechanism for less than t/2; and in a power-on process, there are three parts comprising a linear voltage increasing stage, a voltage maintenance stage and a linear voltage decreasing stage, or two parts comprising the linear voltage increasing stage and the linear voltage decreasing stage.

2. The magnetically-driven control method for the smart rocking chair according to claim 1, wherein there are a plurality of gears; different gears correspond to different rocking amplitudes of the rocking chair; when a shift-up button is pressed, the state detection and control system detects a corresponding gear signal, and provides a first matching PWM voltage control curve, and the rocking amplitude increases by improving the electromagnetic force; and when a shift-down button is pressed, the state detection and control system further detects a corresponding gear signal, and provides a second matching PWM voltage control curve, and the rocking amplitude decreases by reducing the electromagnetic force.

3. The magnetically-driven control method for the smart rocking chair according to claim 1, wherein in the force-applied free rocking, when detecting, by the state detection and control system, that the rocking chair reaches the real-time highest point Lm, and the real-time angle uR is greater than a preset maximum value LK, or detecting, by the state detection and control system, that the rocking chair reaches the real-time highest point Rm, and the real-time angle uR is greater than a preset maximum value RK, the state detection and control system determines that the rocking chair is in an idle state, and sends a stop instruction to stop the rocking chair.

4. The magnetically-driven control method for the smart rocking chair according to claim 1, wherein the electromagnetic drive mechanism comprises a mounting base; the mounting base comprises a first side provided with a drum coil, and a second side provided with a linear bearing; a telescopic mandrel penetrates through the linear bearing; and an end of the telescopic mandrel away from the drum coil is hinged to the rocking chair.

5. The magnetically-driven control method for the smart rocking chair according to claim 4, wherein the state detection and control system comprises a drive circuit connected to the drum coil; the drive circuit is connected to a micro-control unit (MCU); the MCU is connected to a buzzer, a voltage conversion circuit, and a movement information monitoring mechanism; and the drive circuit and the voltage conversion circuit are connected to an adapter through a low-voltage fuse.

6. The magnetically-driven control method for the smart rocking chair according to claim 5, wherein the movement information monitoring mechanism is a gyroscope or a gravitational acceleration sensor.

* * * * *